US010265721B2

(12) United States Patent
Beckett et al.

(10) Patent No.: US 10,265,721 B2
(45) Date of Patent: Apr. 23, 2019

(54) DISPENSER

(71) Applicant: P.C. Cox Limited, Berkshire (GB)

(72) Inventors: Clifford Edward Beckett, Berkshire (GB); Michael John Werson, Hampshire (GB)

(73) Assignee: SULZER MIXPAC AG, Haag (CH)

( * ) Notice: Subject to any disclaimer, the term of this patent is extended or adjusted under 35 U.S.C. 154(b) by 147 days.

(21) Appl. No.: 14/666,641

(22) Filed: Mar. 24, 2015

(65) Prior Publication Data

US 2015/0266050 A1 Sep. 24, 2015

(30) Foreign Application Priority Data

Mar. 24, 2014 (EP) ..... 14161359

(51) Int. Cl.
*B05C 17/01* (2006.01)

(52) U.S. Cl.
CPC ..... *B05C 17/0116* (2013.01); *B05C 17/0103* (2013.01)

(58) Field of Classification Search
CPC ..... B01F 13/0027; B67B 7/00; B05C 11/00; B05C 11/10; B05C 17/01; B05C 17/0103; B05C 17/0116; A47K 5/1217
USPC .... 222/63, 137, 145.5–145.6, 325–327, 333, 222/391; 366/129, 177.1, 152.5; 118/669, 697, 705
See application file for complete search history.

(56) References Cited

U.S. PATENT DOCUMENTS 4,505,225 A * 3/1985 Husain ..... H01L 21/67144 118/669
4,878,601 A * 11/1989 Flemming ..... B01F 13/1058 222/137
5,556,009 A * 9/1996 Motzko ..... B05B 12/085 192/125 A
6,050,450 A * 4/2000 Gardos ..... B01L 3/0206 222/1
6,082,597 A 7/2000 Beckett et al.
(Continued)

FOREIGN PATENT DOCUMENTS

DE 102011081137 A1 2/2013
EP 2314384 A1 4/2011
(Continued)

OTHER PUBLICATIONS

Search Report dated May 16, 2014 for European Patent Application No. 14161359.6 filed Mar. 24, 2014, 8 pages.

*Primary Examiner* — Paul R Durand
*Assistant Examiner* — Andrew P Bainbridge
(74) *Attorney, Agent, or Firm* — Global IP Counselors, LLP

(57) ABSTRACT

A dispenser and related methods of dispensing material, in particular viscous materials, from a container and through a nozzle. The dispenser includes a body portion for holding the container in a fixed relationship with the body portion, a plunger movable to advance with respect to the container to urge material from the container through the nozzle, a motor arranged to move the plunger and a controller arranged to control the motor. The motor is controlled according to a distance traveled by the plunger, for example a dispensing distance or a distance the plunger is retracted away from the nozzle, or the motor is controlled according to a speed of the plunger.

11 Claims, 2 Drawing Sheets

(56) References Cited

U.S. PATENT DOCUMENTS 6,126,039 A * 10/2000 Cline ..... B01F 5/0615 222/145.6
6,216,822 B1 * 4/2001 May ..... F16N 11/08 184/105.1
6,675,988 B2 * 1/2004 Cline ..... B05B 12/1418 222/135
6,682,601 B1 * 1/2004 Beebe ..... B05C 17/00553 118/669
6,711,466 B2 * 3/2004 Abraham ..... B05C 11/10 118/712
6,739,478 B2 * 5/2004 Bach ..... B01L 3/0206 222/1
6,889,872 B2 * 5/2005 Herman ..... B05C 17/00506 222/137
6,932,237 B2 * 8/2005 Heymann ..... A61C 5/064 222/1
7,299,944 B2 * 11/2007 Roady ..... B67D 1/0006 222/1
D636,091 S 4/2011 Brummitt
7,980,428 B2 7/2011 Beckett
8,020,727 B2 * 9/2011 Herman ..... B05C 17/0103 222/1
8,083,498 B2 * 12/2011 Gonnella ..... F04B 25/00 222/63
D660,105 S 5/2012 Brummitt
D660,663 S 5/2012 Brummitt
8,256,645 B2 * 9/2012 Beebe ..... B05C 17/00593 222/333
D673,020 S 12/2012 Brummitt
8,357,338 B2 * 1/2013 Ingo ..... A61C 9/0026 222/333
8,387,825 B2 3/2013 Herman et al.
8,528,785 B2 * 9/2013 Naughton ..... B05C 17/00553 222/137
8,607,824 B2 12/2013 Brummitt
8,616,415 B2 12/2013 Brummitt
8,870,093 B2 10/2014 Brummitt
8,957,608 B2 * 2/2015 Hsu ..... H02P 7/0038 222/251
9,359,122 B2 * 6/2016 Schmid ..... B05C 17/0103
9,452,443 B2 * 9/2016 Grontved ..... G01F 11/022
9,862,001 B2 * 1/2018 Turner ..... B05C 17/012
2004/0045982 A1 * 3/2004 Herman ..... A61C 5/064 222/145.5
2005/0127862 A1 * 6/2005 Glasgow ..... B05C 17/00503 318/280
2010/0252574 A1 10/2010 Busin
2011/0151042 A1 * 6/2011 Strobel-Schmidt ..... B05C 17/0103 425/145
2012/0048893 A1 3/2012 Beckett
2014/0036616 A1 * 2/2014 Ghosh ..... B01F 13/0027 366/129
2016/0374519 A1 * 12/2016 Murphy ..... A47K 5/1217 222/23

FOREIGN PATENT DOCUMENTS

FR 2929537 A1 10/2009
WO WO 00/59643 10/2000
WO WO 2008/048319 A1 4/2008
WO WO 2013/104362 A1 7/2013

* cited by examiner

DISPENSER

RELATED APPLICATION

The present application claims priority to European Application No. 14161359.6, filed Mar. 24, 2014 and entitled, "DISPENSER", which is incorporated herein in its entirety by reference.

FIELD OF THE INVENTION

The present disclosure relates to a dispenser for viscous materials.

BACKGROUND OF THE DISCLOSURE

Dispensers for viscous materials provided in containers such as cartridges or foil ("sausage") packs, or viscous materials provided in bulk, are well known in the art. Such dispensers typically comprise a mechanism, for example an electric motor, which acts to advance a plunger towards a nozzle such that material is forced through the nozzle.

In certain applications, for example when dispensing a chemically reactive material, such as a material which hardens to anchor a component in place, it is desirable to be able to dispense a required amount of material from the dispenser sufficient for the application concerned. Such applications might be, for example, holding a stud in place in a wall. It is important to be able to dispense the correct amount of material from the dispenser in these applications since too much leads to unnecessary waste, whereas too little risks that the component is not sufficiently well anchored in place, resulting in the obvious safety implications.

One example of a known dispenser for chemically reactive materials involves dispensing material through a mixer from a plurality of containers, typically two, each container containing a different material.

It is also desirable to control the dispensing of material such that, once a required amount of material is dispensed, excess material does not drip from the nozzle of the dispenser. Such dripping also results in material wastage, for example.

Typically, there is a need to accurately control the mechanism to dispense material in a controlled manner.

SUMMARY OF THE DISCLOSURE

In a first aspect, there is provided a dispenser for dispensing a material from a container through a nozzle, the dispenser comprising a body portion for holding the container in a fixed relationship with the body portion; a plunger moveable to advance with respect to the container to urge material from the container through the nozzle; a motor arranged to move the plunger; and a controller arranged to control the motor. The controller is configured to control the motor based on a distance traveled by the plunger, or on the speed at which the plunger moves, or both.

Advantageously, controlling the motor based on the distance traveled by the plunger enables the dispenser to dispense material according to the volume of material dispensed. This allows the dispenser to advance the plunger for a set distance corresponding to a volume to be dispensed. Accordingly, a set volume can be dispensed independent of the viscosity of the material. By contrast, dispensers which control dispensing according to, for example, a duration of travel of the plunger and a dispensing force or motor current will dispense a volume of material that depends on the viscosity of the material.

Control of the plunger based on the distance traveled may also be achieved indirectly by controlling the motor to advance the plunger at a controlled speed for a set time period, corresponding to the set distance.

By controlling the motor based on the speed at which the plunger travels, improved control of the dispensing rate can be achieved, for example, a substantially constant dispensing rate can be achieved. Additionally, the dispensing rate can be controlled independent of the viscosity of the material to be dispensed.

For the avoidance of doubt, the plunger may travel in the forward or reverse direction.

In some embodiments, the distance through which the plunger has traveled may be measured directly. For example, a sensor or plurality of sensors arranged to determine how far the plunger has traveled may be provided. In some embodiments, the distance is derived based on the known relationship between a rotation of the motor and the distance traveled by the plunger (e.g. motor to plunger rack gearing) and absolute motor position or counts of motor position encoder pulses.

In some embodiments, the distance through which the plunger has traveled may be measured indirectly. For example, the distance may be determined based on measurements associated with the motor. In some embodiments, the distance is calculated from the motor speed. For example, speed measurements may be integrated over time to determine the distance traveled by the plunger.

In some embodiments, signals indicative of the speed of the motor may be transmitted from the motor at regular intervals such that the distance traveled by the plunger may be calculated by summing the speed signals received. Other suitable techniques may also be used as will be apparent to those skilled in the art.

In some embodiments, the controller may be arranged to calculate the distance traveled by the plunger, for example, based on an output from the sensor or plurality of sensors, or based on the determined motor speed. Alternatively, a processor or other suitable component may be provided to calculate the distance traveled by the plunger. In some embodiments, the controller comprises an integrator for calculating the distance traveled by the plunger.

Where the distance traveled by the plunger is calculated from the motor speed, the motor speed must be determined. In some embodiments, motor speed can be determined from a measurement of back EMF where the running motor creates a back EMF proportional to the speed of the motor.

In some embodiments, back EMF may be calculated based on a measurement of motor current (which indicates motor torque). In some embodiments, the back EMF of the motor can be measured by electrically disconnecting the motor for a short period of time and measuring the motor voltage once the motor current has reached zero. Other suitable methods for measuring or estimating the back EMF of the motor may be used as will be appreciated by those skilled in the art.

In some embodiments, the motor speed may be measured, using an encoder or using an optical or magnetic switch. In such embodiments a signal is transmitted from the motor when the motor occupies a predetermined rotary position. As the motor rotates, the signals are transmitted at intervals corresponding to the speed of the motor. In some embodiments a tachometer may be used to determine motor speed.

In some embodiments, motor speed may be measured in any suitable way as will be apparent to those skilled in the art. For example, where the motor is a commutated motor, current ripple in the motor current due to the commutator switching may be detected and used to determine the speed of the motor.

In some embodiments, the dispenser may be powered by a battery. In other embodiments, the dispenser may be powered by a mains electricity supply. Other suitable power supply means may be used, as will be appreciated by those skilled in the art. In some embodiments, the dispenser may be arranged to be powered by more than one power supply means.

In some embodiments, the motor may be a brush commutated direct current (DC) motor. A brush commutated DC motor may be driven using a direct current power supply, for example, a battery. Alternatively, an alternating current (AC) source, such as the mains supply may be used to power the brush commutated DC motor. In such embodiments, a rectifier may be provided to convert the alternating current from the power supply to a direct current provided to the motor, as will be understood by those skilled in the art. Other types of motors, such as brushless DC motors, permanent magnet motors or switched reluctance motors may be used.

In some embodiments, the motor may be an AC motor. An AC motor may be driven using an alternating current power supply, for example, the mains power supply. Alternatively, a direct current may be used to power the AC motor. In such embodiments, a power inverter may be provided to convert the direct current from the power supply to an alternating current provided to the motor, as will be understood by those skilled in the art.

Any other suitable type of motor may be used as will be understood by those skilled in the art.

In some embodiments the controller may be configured to control the torque and/or to protect against damage to the motor, for example, over current or overheating, and the battery, for example under voltage.

In some embodiments, the dispenser comprises a trigger for controlling the dispensing of material by the user. For example, the trigger may be an on/off switching means such that actuation of the trigger enables activation of the motor.

In some embodiments, the trigger is coupled to a potentiometer (or any suitable variable resistor or other device for receiving a graduated input), for example by a mechanical link, such that the dispensing speed may be directed by the user. For example, the degree to which the trigger is depressed causes a corresponding setting of the potentiometer which is detected by the controller. The controller then determines a desired motor speed based on these measurements. For example, the greater the degree of depression of the trigger, the greater the speed of the motor and hence the faster the rate at which material is dispensed from the dispenser.

In some embodiments, the trigger is provided on a handle of the dispenser such that the trigger may be actuated by a user's hand whilst holding the handle. This is beneficial to the user since it provides an ergonomic arrangement.

In some embodiments, the controller determines an actual motor speed using the techniques described above. Alternatively, the motor speed may be measured using any other suitable means. The controller may compare the actual motor speed with a desired motor speed. Where an error exists between the desired motor speed and the actual motor speed, the controller may adjust the speed of the motor to minimise this error. Accordingly, the controller may act as a control loop feedback mechanism, for example, a proportional-integral (PI) controller. Any other suitable means of feedback control may be used to control the speed of the plunger, as will be apparent to those skilled in the art.

In some embodiments, a battery pack may also be located in the handle or be arranged to be attachable to the handle.

In some embodiments, the motor is arranged to cause movement of the plunger by means of a gearing arrangement configured to engage a rack. For example, the rack may comprise the plunger. The rack may be formed of an elongate rod having a series of teeth. The gearing arrangement may comprise a gear comprising teeth which may engage the teeth of the rack, such that rotation of the motor causes rotation of the gear, which in turn causes linear motion of the rack to advance or retract the plunger.

The dispenser may comprise a clutch arrangement actuatable by the user and arranged to cause the motor and the gearing arrangement to be engaged or disengaged. When disengaged, the rack (and hence plunger) may be retracted manually, for example, enabling a cartridge to be removed. Alternatively, the plunger may be retracted to enable the cartridge to be removed by reversing the motor. In such embodiments, a clutch arrangement may not be necessary.

In some embodiments the clutch arrangement may be provided on the handle such that the clutch arrangement may be manipulated by a user's hand whilst holding the handle. This is beneficial to the user since it provides an ergonomic arrangement.

In some embodiments, the container is a replaceable cartridge. In such embodiments, when all the material in the cartridge has been dispensed the cartridge may be removed from the dispenser and a new cartridge fitted. The empty cartridge may then be refilled for further use, or discarded.

In some embodiments, the dispenser may be arranged to dispense material from a plurality of containers, for example provided by a cartridge having a plurality of compartments, for example arranged as barrels in the cartridge. For example, 2, 3, 4, or any other suitable number of containers may be used. Each container may contain a different material such that when material from the plurality of containers is dispensed, the materials mix. For example, the material may be chemically reactive. The dispenser or cartridge may comprise a mixer to aid mixing of material from the plurality of containers. In some embodiments, the compartments are provided as separate containers. In some embodiments, the mixer is provided separately.

In a second aspect, there is provided a dispenser for dispensing a material from a container through a nozzle, the dispenser comprising a body portion for holding the container in a fixed relationship with the body portion; a plunger moveable to advance with respect to the container to urge material from the container through the nozzle; a motor arranged to move the plunger; and a controller arranged to control the motor. The controller is configured to determine a dosing amount of material to be dispensed from the dispenser and to control the motor such that the plunger is advanced a dispensing distance such that the dosing amount is dispensed.

Advancing the plunger through the dispensing distance results in a volume of material corresponding to the dosing amount being dispensed. Advantageously, the same volume of material will be dispensed irrespective of the viscosity of the material, since the motor will advance the plunger the dispensing distance corresponding to the dosing amount irrespective of the speed of the motor or the time taken to dispense the material. Therefore, the dispenser is not sensitive to factors such as the viscosity of the material being dispensed.

In some embodiments, the dispensing distance to be traveled by the plunger is determined as a stand-alone calculation for each dose of material dispensed. For example, where the distance traveled is calculated by an integrator, the integrator is reset to zero prior to calculation of the dispensing distance for each dose of material to be dispensed such that any distance previously traveled by the plunger is not included in the calculation. This has the advantage that should any error be present in the calculation, such errors are not cumulative but are limited to that particular dosing stroke.

In some embodiments, the dosing amount is a fixed amount, in other words, the dosing amount may not be varied. For example, for a dispenser used to dispense a single type of material, the dosing amount may be a preset feature of the dispenser corresponding to the required dose of the material.

Alternatively, in some embodiments, the dosing amount may be varied. For example, a user may set a desired dose setting. The dispenser may comprise a user input arrangement to enable a user to set a dosing amount. For example, a dial, push button, or other selection means to enable the user to select a desired dose may be provided.

In some embodiments, the user input arrangement is provided on a handle of the dispenser such that the dosage setting user input may be manipulated by a user's hand whilst holding the handle. This is beneficial to the user since it provides an ergonomic arrangement.

In other embodiments, the dose may be automatically selected by inserting a cartridge into the dispenser. For example, certain cartridges may engage a portion of the dispenser, for example a switch, such that dosing amount is selected. The dosing amount may be coded by a machine readable indicium on the cartridge, for example a bar code, QR code or RFID, and a corresponding reader may be provided on the dispenser.

In some embodiments, once the plunger has traveled a desired distance, for example, the dispensing distance, the direction of the motor is reversed, hence causing the plunger to retract away from the nozzle. The motor may reverse for a predetermined time. Alternatively the motor may reverse for a predetermined distance. In some embodiments, control of the reversing of the motor is based on a distance traveled by the plunger.

In some embodiments, the dispensing distance is a sum of a distance corresponding to the dosing amount, based on the cross-sectional area inside the container/compartment(s), and a distance through which the plunger is retracted in the previous stroke. Accordingly, advance of the plunger through the dispensing distance will correspond to the desired volume of material being dispensed, corrected to account for any retraction of the plunger in the previous stroke.

The term 'stroke' is herein understood to mean the advance of the plunger to dispense a desired amount of material followed by, if applicable, retraction of the plunger through a desired retract distance.

In a third aspect there is provided a dispenser for dispensing a material from a container through a nozzle, the dispenser comprising a body portion for holding the container in a fixed relationship with the body portion; a plunger moveable to advance with respect to the container to urge material from the container through the nozzle; a motor arranged to move the plunger; and a controller arranged to control the motor. The controller is configured such that, once a desired amount of material has been dispensed, the motor is reversed to retract the plunger a distance away from the nozzle.

The distance through which the plunger is retracted may be determined as a function of a distance advanced by the plunger to dispense the desired amount of material, or may be a predetermined distance.

In some embodiments, when the plunger is retracted, the material is not drawn back into the container, but rather the pressure exerted by the plunger on the container which acts to push the material out of the nozzle is removed. In either case, reversing the direction of the motor after dispensing has the advantage of preventing material dripping from the nozzle of the dispenser.

In some embodiments, control of the reversing of the motor is based on a signal indicative of plunger position or plunger speed.

It will be appreciated that each of the features described above may apply to each aspect described. All possible combinations are not listed in detail here for the sake of brevity.

BRIEF DESCRIPTION OF THE FIGURES

A specific embodiment is now described by way of example only and with reference to the accompanying drawing in which.

Figure 1:
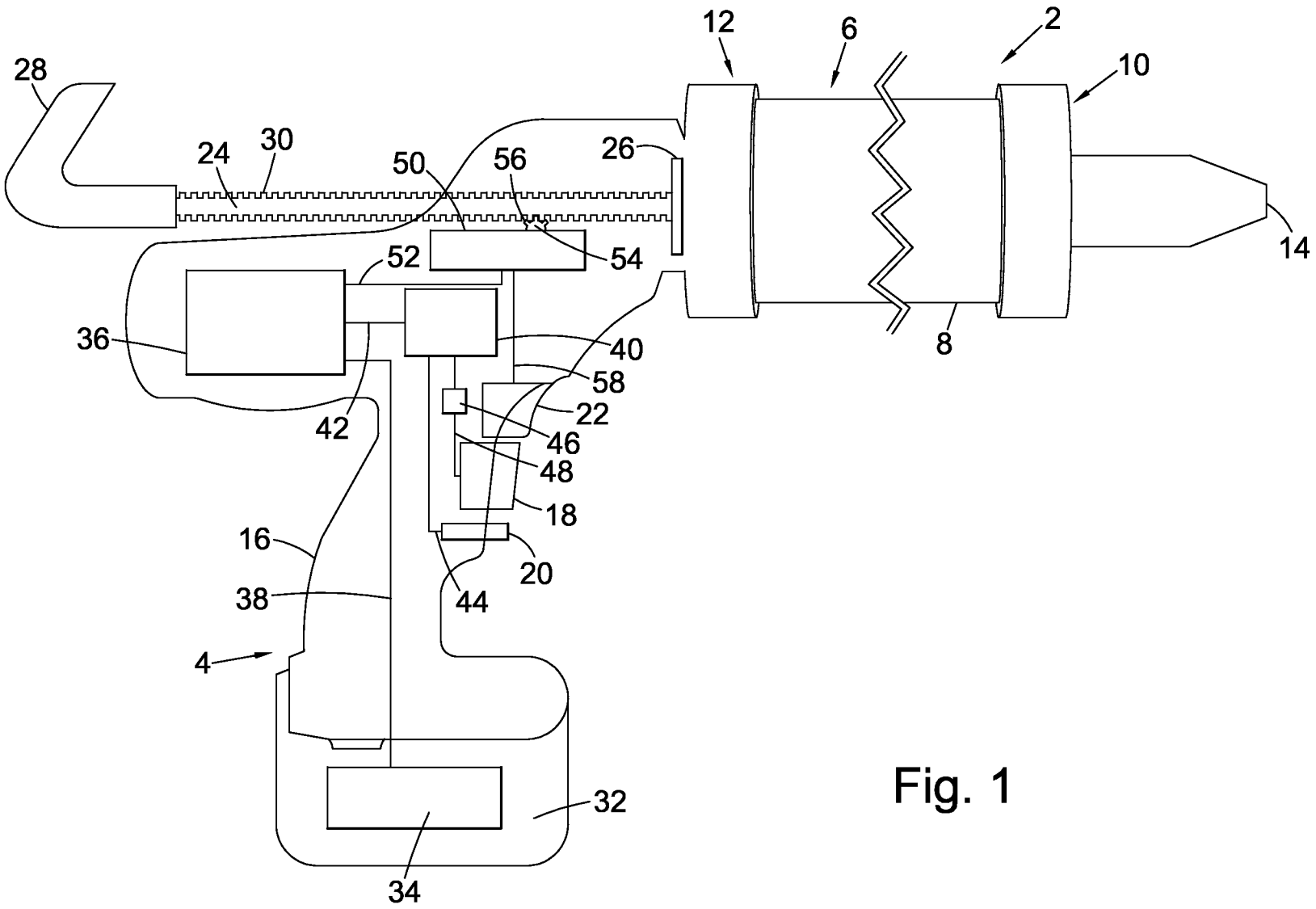
FIG. 1 shows a schematic of a dispenser.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE FIGURES

With reference to FIG. 1, a dispenser 2 comprises a body having a stock portion 4 and a holder portion 6. The holder portion 6 comprises a cylindrical outer wall portion 8 defining a compartment in which a replaceable cartridge (not shown) may be housed, the cartridge containing a viscous material to be dispensed. The outer wall portion 8 is closed at a front end by a front cap 10 and closed at a rear end by a rear cap 12. The front cap 10 comprises a nozzle 14 through which the material may be dispensed.

The stock portion 4 comprises an ergonomically shaped handle 16 accommodating a trigger 18 for controlling flow of the material from the nozzle 14, a dial 20 for selecting an amount of material to be dispensed, for example, a dosing amount, and a clutch arrangement 22, described in more detail below.

The dispenser 2 further comprises a rack 24 having at a first end a plunger 26 arranged to abut an end of the cartridge, and at a second end a hook 28. The rack 24 comprises a series of teeth 30 along its length.

The stock portion 4 further comprises a power supply 32 comprising a battery 34 for providing power to a motor 36 via a connection 38. The motor 36 is accommodated within the stock portion 4 and is a brush commutated DC motor.

The stock portion 4 also accommodates a controller 40 for controlling the operation of the motor 36 via a connection 42. The controller 40 comprises an integrator (not shown) which calculates the distance traveled by the plunger, as will be described in more detail below. The dial 20 is coupled to the controller 40 via a connection 44, and the trigger 18 is coupled to the controller 40 by a connection 48. A potentiometer 46 is provided such that the trigger 18 may actuate the potentiometer 46, for example, via a mechanical link. The stock portion 4 further accommodates a gearing arrangement 50 coupled to the motor 36 via a connection 52 and comprising a gear 54 having teeth 56 arranged for engagement with the teeth 30 of the rack 24. The clutch arrangement 22 is coupled to the gearing arrangement 50 via a connection 58 and is arranged to engage and disengage the gear 54 and the motor 36.

In use, the front cap 10 is removed, a cartridge containing a viscous material is inserted into the compartment defined by the cylindrical outer wall 8 of the dispenser 2, and the front cap 10 is secured back in place. To aid positioning of the cartridge in place, the clutch arrangement 22 is actuated such that the gear 54 and the motor 36 are disengaged, thereby enabling the position of the rack 24 to be adjusted such that the plunger 26 abuts an end of the cartridge. A user may use the hook 28 to aid adjustment the position of the rack 24. The clutch arrangement 22 may then be released such that the gear 54 and motor 36 are engaged.

An amount of material to be dispensed may be selected by manipulation of the dial 20. The setting of the dial 20 is communicated to the controller 40 via the connection 44.

Figure 2:
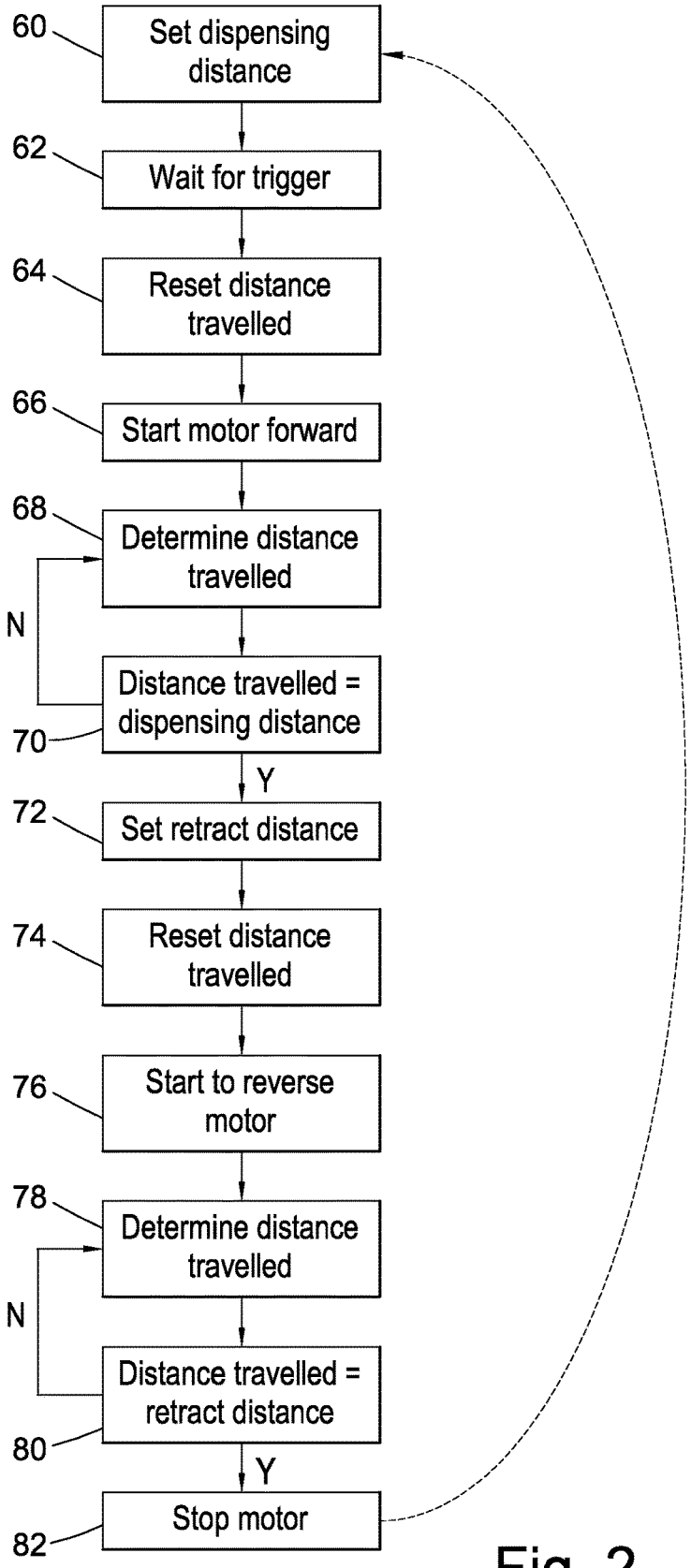
FIG. 2 shows a flow diagram illustrating the dispenser in use.

Referring to FIG. 2, a control process for dispensing is now described. As indicated at reference numeral 60, the controller 40 determines a desired distance of travel of the plunger 26, or dispensing distance, based on the setting of the dial 20 in order to dispense a corresponding amount of material as set on the dial. For example, the dial 20 may comprise a scale of graduations indicative of a desired volume of material to be dispensed. When the dial 20 is set to a certain graduation, a desired distance of advance of the plunger 26 is determined corresponding to the desired volume of material to be dispensed as indicated on the dial 20. Determining the desired distance of advance of the plunger 26 takes account the cross sectional area of the cartridge such that the desired volume of material is dispensed, such that the product of the desired distance and the cross-sectional area of the cartridge (of all barrels of the cartridge if more than one) corresponds to the desired volume.

Where the plunger 26 was retracted through a distance at the end of the previous stroke, the dispensing distance is determined based on the setting of the dial 20 and the distance retracted by the plunger 26 in the previous stroke. For example, the dispensing distance may be a sum of a distance determined by the setting of the dial 20 (as described above) and the distance retracted by the plunger 26 in a previous stroke. Accordingly, advance of the plunger 26 through the dispensing distance will correspond to the desired volume of material being dispensed, corrected to account for any retraction of the plunger 26 in the previous stroke.

Once the dispensing distance has been set, the controller 40 monitors for signals received from the trigger 18 to determine when the trigger 18 has been depressed, as indicated at reference numeral 62.

As described above, the controller 40 comprises an integrator configured to determine the distance traveled by the plunger. The integrator is reset to zero, indicated at reference numeral 64, before carrying out calculations to determine the distance traveled by the plunger such that the integrator provides a distance estimate relative to the last resting position of the plunger 26.

On depression of the trigger 18, the controller 40 detects the degree to which the trigger 18 is depressed from the corresponding setting of the potentiometer 46. Based on this, the controller 40 determines a desired motor speed. The greater the degree to which the trigger 18 is depressed, the higher the desired speed of the motor 36. The controller 40 then directs the motor 36 to run, according to the desired motor speed, as indicated by reference numeral 66.

When activated, rotation of the motor 36 is converted to rotation of the gear 54 via the gearing arrangement 50. By engagement of the teeth 56 of the gear 54 with the teeth 30 of the rack 24, rotation of the gear 54 causes linear motion of the rack 24. Accordingly, activation of the motor 36 results in linear motion of the rack 24, which causes the plunger 26 to be advanced and retracted towards and away from the nozzle 14, depending on the direction of rotation of the motor 36.

When the plunger 26 is advanced towards the nozzle 14, the plunger 26 applies a force to one end of the cartridge, causing material to be forced from the cartridge through the nozzle 14.

As the plunger 26 advances towards the nozzle 14, the distance traveled by the plunger 26 is monitored, as indicated by reference numeral 68. The monitored distance traveled by the plunger 26 is compared against the dispensing distance, as identified at reference numeral 70. If the distance traveled by the plunger 26 has reached the dispensing distance, advance of the plunger 26 is halted. If the distance traveled by the plunger 26 has not yet reached the dispensing distance, the controller 40 continues to monitor the distance traveled by the plunger 26 until the desired distance is reached.

To monitor the distance traveled by the plunger, the controller 40 calculates the back EMF of the motor 36 from the motor current and from this calculates the motor speed of the motor 36. Alternatively, the back EMF of the motor 36 may be calculated or estimated by any other suitable means as will be understood by those skilled in the art. The calculated or estimated back EMF may be used to determine the motor speed since the motor creates a back EMF proportional to the speed of the motor. The distance traveled by the plunger 26 may then be determined based on the determined motor speed. For example, a calculation of motor speed results in a value which is stored as a variable. The position of the plunger 26 is determined by integrating this variable over a prescribed time period. In some embodiments where motor speed is determined in discrete digital samples, the distance traveled is determined by summing the speed samples and multiplying by a scaling factor.

Once the distance traveled by the plunger 26 has reached the dispensing distance, corresponding to the desired amount of material to be dispensed, the controller 40 directs the motor 36 to stop or run in reverse (as will be described below), thereby halting the advance of the plunger 26.

The controller 40 determines a retract distance, indicated at reference numeral 72, through which the plunger 26 is to be reversed. The retract distance is determined as a function of the distance advanced by the plunger 26 to dispense the desired amount of material or is a predetermined distance.

Once the retract distance has been determined, the integrator is reset to zero before beginning to calculate the distance refracted by the plunger 26, as indicated at reference numeral 74. This provides a distance estimate relative to the last resting position of the plunger 26.

The controller 40 directs the motor 36 to run in reverse, indicated by reference numeral 76, thereby retracting the plunger 26 from the cartridge. When the plunger 26 is refracted away from the nozzle 14, the force applied to the cartridge, and hence the force applied to the material, is removed and the material remains in the cartridge without oozing.

As the plunger 26 retracts, the distance retracted by the plunger 26 is monitored, as indicated by reference numeral 78. The monitored distance retracted by the plunger 26 is compared against the retract distance, as indicated by reference numeral 80. If the distance traveled by the plunger 26 has reached the retract distance, movement of the plunger 26 is halted. If the distance traveled by the plunger 26 has not yet reached the retract distance, the controller 40 continues to monitor the distance traveled by the plunger 26 until the retract distance is reached.

The distance through which the plunger 26 has refracted is determined based on the motor speed using a similar technique to that described above in relation to determining the distance advanced by the plunger 26.

Once the distance traveled by the plunger 26 has reached the retract distance, the plunger 26 is halted by deactivation of the motor 36, indicated at reference numeral 82.

To dispense a subsequent dose of material, the same process as outlined above is followed, only inserting a new cartridge when required. Since the integrator is reset at the start of each dispensing stroke, each dispensing distance is determined as a stand-alone calculation such that any errors which may occur in the calculation are not cumulative.

Once all material in the cartridge has been dispensed, the cartridge may be removed from the dispenser 2. To do this, the clutch arrangement 22 is actuated such that the gear 54 and the motor 36 are disengaged, thereby enabling the position of the rack 24 to be adjusted to retract the plunger 26 away from the end of the cartridge. The user may use the hook 28 to aid adjustment the position of the rack 24. The cartridge may then be removed from the compartment defined by the cylindrical outer wall 8 of the dispenser 2.

It will be understood that the order in which the acts outlined in FIG. 2 are carried out is by way of example only. It will be clear that operation of the dispenser is not limited to the order provided in FIG. 2. For example, the dispensing distance and retract distance may both be determined prior to dispensing beginning, or the motor may be stopped between being run in forward and then in reverse.

In some embodiments, the dispenser does not comprise a clutch arrangement. In such embodiments the plunger 26 may be retracted from the cartridge by driving the motor 36 in reverse, thereby enabling the cartridge to be removed from the compartment defined by the cylindrical outer wall 8 of the dispenser 2.

In some embodiments, the dispenser 2 is arranged such that the plunger 26 travels at a constant speed, such that material may be dispensed at a constant velocity. In use, to begin dispensing material, the trigger 18 is depressed. The degree to which the trigger 18 is depressed causes a corresponding setting of the potentiometer 46, which is detected by the controller 40. Based on the setting of the potentiometer 46, the controller 40 determines a desired motor speed. The greater the degree to which the trigger 18 is depressed, the higher the desired speed of the motor 36 and hence the higher the desired plunger speed. Alternatively, the desired motor speed, and hence desired plunger speed, may be a preset value.

The controller 40 directs the motor 36 to run according to the desired motor speed.

The controller 40 determines the actual motor speed using the techniques described above. Alternatively, the motor speed may be measured using any other suitable means. The controller 40 compares the actual motor speed with the desired motor speed. Where an error exists between the desired motor speed and the actual motor speed, the controller 40 adjusts the speed of the motor to minimise this error. Accordingly, the controller 40 acts as a control loop feedback mechanism, for example, a proportional-integral (PI) controller.

It will be understood that the above description is of specific embodiments by way of example only and that many modifications, juxtapositions and alterations will be within the skilled person's reach and are intended to be covered by the scope of the appendent claims. For example, the dispenser may be arranged to dispense material from containers having a plurality of compartments, for example a multi-barrel cartridge comprising a plurality of barrels, e.g. two barrels.

The invention claimed is:

1. A dispenser for dispensing a material from a container through a nozzle, the dispenser comprising:

a body portion for holding the container in a fixed relationship with the body portion;

a plunger moveable to advance with respect to the container to urge material from the container through the nozzle;

a motor arranged to move the plunger; and a controller arranged to control the motor;

wherein the controller is configured to calculate a back-EMF of the motor from a motor current, and use the back-EMF to calculate an actual motor speed, and configured to compare a desired motor speed and the actual motor speed and is arranged to act to minimize a difference between the desired motor speed and the actual motor speed and thereby to control the motor based on a speed at which the plunger moves, wherein the controller is further configured to determine a dosing amount of material to be dispensed from the dispenser and to control the motor such that the plunger is advanced a dispensing distance such that the dosing amount is dispensed, wherein the dispensing distance to be traveled by the plunger is determined as a stand-alone calculation for each dose of material dispensed.

2. The dispenser of claim 1, wherein the controller comprises an integrator configured to calculate the distance travelled by the plunger, wherein the integrator is reset prior to each dispensing stroke.

3. The dispenser of claim 1, further comprising a user input arrangement such that the dosing amount can be selected using a dial.

4. The dispenser of claim 1, wherein, the controller causes the motor to reverse once the plunger has travelled the dispensing distance such that the plunger is retracted from the nozzle.

5. The dispenser of claim 1, wherein the controller is further configured such that, once a desired amount of material has been dispensed, the motor is reversed to retract the plunger a distance away from the nozzle.

6. The dispenser according to claim 5, wherein control of the reversing of the motor is based on a distance travelled by the plunger.

7. The dispenser of claim 5, wherein the distance to be retracted by the plunger is determined as either a function of the distance advanced by the plunger to dispense the desired amount of material or a predetermined distance.

8. The dispenser of claim 1, wherein the controller is configured to determine the distance travelled by the plunger based on the actual motor speed of the motor.

9. The dispenser of claim 1, further comprising: a trigger arranged such that depressing the trigger causes rotation of the motor.

10. The dispenser of claim 9, wherein a degree to which the trigger is depressed directs a speed of rotation of the motor.

11. The dispenser of claim 1, wherein the body portion holds a plurality of containers and wherein the controller is arranged to dispense material such that a first material dispensed from a first container mixes with a second material dispensed from a second container.

* * * * *